US007047890B2

(12) United States Patent
Korber et al.

(10) Patent No.: US 7,047,890 B2
(45) Date of Patent: May 23, 2006

(54) INTEGRATED FLAT PANEL WORKSTATION SYSTEM

(76) Inventors: Jeffrey Korber, 83 Jacobs Rd., Rockaway, NJ (US) 07866; Peter Stengel, 10717 Faulkner Ridge Cir., Columbia, MD (US) 21044; James Babcock, 18807 Graystone Rd., White Hall, MD (US) 21161

( * ) Notice: Subject to any disclaimer, the term of this patent is extended or adjusted under 35 U.S.C. 154(b) by 232 days.

(21) Appl. No.: 10/616,461

(22) Filed: Jul. 9, 2003

(65) Prior Publication Data

US 2004/0123782 A1 Jul. 1, 2004

Related U.S. Application Data

(60) Provisional application No. 60/436,515, filed on Dec. 27, 2002.

(51) Int. Cl.
*A47B 37/00* (2006.01)

(52) U.S. Cl. ..... 108/50.01; 108/7

(58) Field of Classification Search ..... 108/50.01, 108/50.02, 147, 1, 7; 312/223.2, 223.6, 223.3, 312/223.1; 248/917, 919, 920, 922, 923
See application file for complete search history.

(56) References Cited

U.S. PATENT DOCUMENTS 4,766,422 A * 8/1988 Wolters et al. ..... 312/223.3
5,199,773 A * 4/1993 Price et al. ..... 312/194
5,294,193 A * 3/1994 Wegman et al. ..... 312/223.3
5,410,972 A * 5/1995 Schairbaum ..... 108/50.01
5,526,756 A * 6/1996 Watson ..... 108/50.01
5,626,323 A * 5/1997 Lechman et al. ..... 108/50.01
5,651,594 A * 7/1997 Lechman ..... 312/223.3
5,699,225 A * 12/1997 Yavitz et al. ..... 108/50.01
6,128,186 A * 10/2000 Feierbach ..... 312/223.3
6,168,250 B1 * 1/2001 Rogov ..... 248/917
D438,401 S * 3/2001 Lechman ..... D6/423
6,237,507 B1 * 5/2001 Yanagisawa et al. .... 108/50.01
6,286,440 B1 * 9/2001 Jyringi ..... 108/50.01
6,474,760 B1 * 11/2002 Rauls ..... 108/50.01
6,553,919 B1 * 4/2003 Nevin ..... 108/50.01
6,609,465 B1 * 8/2003 Kolavo ..... 108/50.01

* cited by examiner

*Primary Examiner*—Jose V. Chen
(74) *Attorney, Agent, or Firm*—Law Offices of Royal W. Craig

(57) ABSTRACT

A computer workstation having a desktop/work surface defined by a central aperture and a pivoting liquid crystal display (LCD) support panel mounted on pivot shafts in the aperture. In addition, a sliding input device platform is mounted on telescoping roller brackets underneath the front edge of the work surface. Lever arms are rotatably engaged with the pivot shafts and are linked to the roller brackets. The lever arms automatically pivot the LCD support panel to an upright position upon extension of the input device platform, and vice versa, and a hydraulic damper brings the LCD support panel to a safe, gentle stop. Aa mercury switch turns the LCD on and off automatically upon opening or closing. Two or more such LCD support panels and associated hardware can be included in a single desktop/work surface for a computer training and/or conferences.

17 Claims, 9 Drawing Sheets

INTEGRATED FLAT PANEL WORKSTATION SYSTEM

CROSS-REFERENCE TO RELATED APPLICATIONS

The present application derives priority from U.S. provisional application No. 60/436,515 for "INTEGRATED FLAT PANEL DESK SYSTEM; Filed: 27 Dec. 2002.

BACKGROUND OF THE INVENTION

1. Field of the Invention

The present invention relates to computer workstations and, more particularly, to a computer workstation having a pivoting working surface that exposes an integrated flat panel liquid crystal display (LCD).

2. Description of the Background

Of the many varieties of commercially-available computer workstations, some are designed to enclose the computer to offer a multi-use work surface, conserve space, provide data privacy, protect the equipment and wiring, and maintain aesthetics. Examples of typical applications include educational and medical institutions, commercial offices, and retail, hospitality, government, and military entities. In these and other situations, it is desirable to incorporate the computers into the desks.

The are many exemplary patents for computer desks, most of which stow the CPU and monitor under the desk surface. For example, U.S. Pat. No. 4,766,422 to Wolters shows a desk with a standard computer system case and monitor. U.S. Pat. No. 5,611,608 to Clausen shows a desk with a standard computer system CPU and monitor. The desk is designed with an "L" shaped work area with two levels. The "L" shaped configuration limits the work area, as well as contributing to a setup problem for the student and teacher.

There are also a number of computer desks in which the monitor is placed below the desk top, employing a glass window or removable cover placed above the monitor so that the monitor remains or can be made visible to the user. For instance, U.S. Pat. No. RE034266 to Schairbaum shows a work station with an underdesk display. U.S. Pat. No. 5,957,059 to Burhman depicts a desk with a work surface that retracts to expose a computer system case and monitor. A hinged panel is manipulated to enable the user to see the viewable surface of the monitor. The foregoing systems are acceptable for cathode ray tube (CRT) monitors because they generate a positive light image which can easily be viewed from any angle. However, with the advent of flat panel LCDs, the situation has changed. LCD flat panel displays transmit images in a different manner, requiring the user to view them straight on. The highly directional images and lower light emission levels make it difficult to view an LCD screen through a glass surface or to position the display so that the user can view it straight on in an ergonomic manner.

LCDs offer many advantages over CRT monitors such as requiring less room and using less energy. There is, therefore, a need for a more functional, ergonomically correct, and convenient multi-use computer workstation accommodating LCDs in which the display may be pivoted from a closed secure position into an ergonomically appropriate open position in front of a user.

Additionally, due to the increased energy management capabilities of LCDs, when combined with the advantages of a pivoting display mechanism, the workstation is able to provide convenient data security without shutting down the computer workstation or requiring a lengthy warm-up period before re-accessing the screen. The addition of automatic activation and brightness adjustment upon opening the LCD will increase the display's useful life and make LCD units more appropriate for use in a broad variety of situations such as darkened classroom presentations and work locations where screen brightness may be used to eliminate problems with glare.

SUMMARY OF THE INVENTION

It is, therefore, an object of the present invention to provide a compact, functional, ergonomically correct and convenient multi-use computer workstation in which a pivoting flat panel integral to the work surface rotates a LCD into a vertical position in front of a user.

It is another object to provide a computer workstation with an integral flat panel as described above in which the pivoting of the flat panel from a closed to an open position is triggered automatically by the user extending a sliding (i.e. pull-out) input device platform.

It is another object to provide a computer workstation with an integral flat panel as described above with locking sliding (i.e. pull-out) input device platform, and in which the flat panel display (and optionally, integral personal computer) are securely stowed and locked in a closed position until the input device platform is unlocked and extended, thereby providing ample security of the hardware and data therein.

It is another object to provide a computer workstation with an integral flat panel as described above in which the action of pivoting the flat panel, even when done abusively, from a closed to an open position is controlled so as to protect the delicate circuitry of the equipment prevent personal injury and/or damage to the workstation, as well as positioning the LCD and flat panel at the ideal angle when open and perfectly level to a work surface when closed.

It is still another object to provide a computer workstation with a flat panel LCD as described above in which the LCD is automatically pivoted into a viewable position by extending the input device platform, is automatically turned on when it attains the viewing position, and is automatically adjusted for display brightness in accordance with the ambient light conditions in the room.

According to a preferred embodiment of the present invention, the above-described and other objects are accomplished by providing a computer workstation having a desktop/work surface defined by a central aperture, and a pivoting, integral LCD support panel positioned in the aperture. A flat panel LCD is mounted on the support panel which is, in turn, affixed to two rotatable shafts. In addition, a sliding input device platform (e.g. keyboard shelf) is mounted on telescoping roller brackets underneath the front end of the work surface. Pivoting lever assemblies include lever arms coupled to the rotatable shafts and links coupled to the roller brackets. A hydraulic damper is coupled at one end to one of the lever arms and slidably attached at the other end in a slotted bracket affixed to the underside of the desktop/work surface. The lever assemblies serve to automatically pivot the LCD support panel to an upright position upon extension of the input device platform. The damper freely extends as the LCD support panel is opened to its upright position, but is engaged as the support panel is closed to bring the support panel and attached LCD to a safe and gentle stop. In this preferred embodiment, the LCD additionally includes a mercury switch for turning the LCD on once it has attained an upright position (i.e. the support panel is in the fully open position), and for turning it off when the support panel is in the closed position.

As a preferred option, the sliding input device platform includes a locking device which prevents unauthorized access to the input device and to the LCD display to protect the hardware. In addition, it is contemplated that the computer workstation may be integrally incorporated with the display, in which case the locking device prevents unauthorized data access as well. While the locking device may be a simple keylock, the presently preferred embodiment includes a Dialock® system by which multiple computer desks all with pivoting LCD support panels may be centrally unlocked using a single transponder stick inserted in a wall receptacle. This intelligent key system is completely tamper-proof.

An alternative multi-display embodiment of the present invention incorporates a large tabletop/work surface defined by multiple (i.e. two or more) apertures, with a pivoting, integral LCD support panel positioned in each of the apertures. A flat panel LCD is mounted on each of the support panels and a sliding input device platform is mounted on telescoping roller brackets underneath the edge of the work surface directly in front of each support panel and LCD. The pivoting mechanism for each LCD is as described above, and each LCD may be pivoted to an upright position, independently of the others, by extending the corresponding input device platform.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
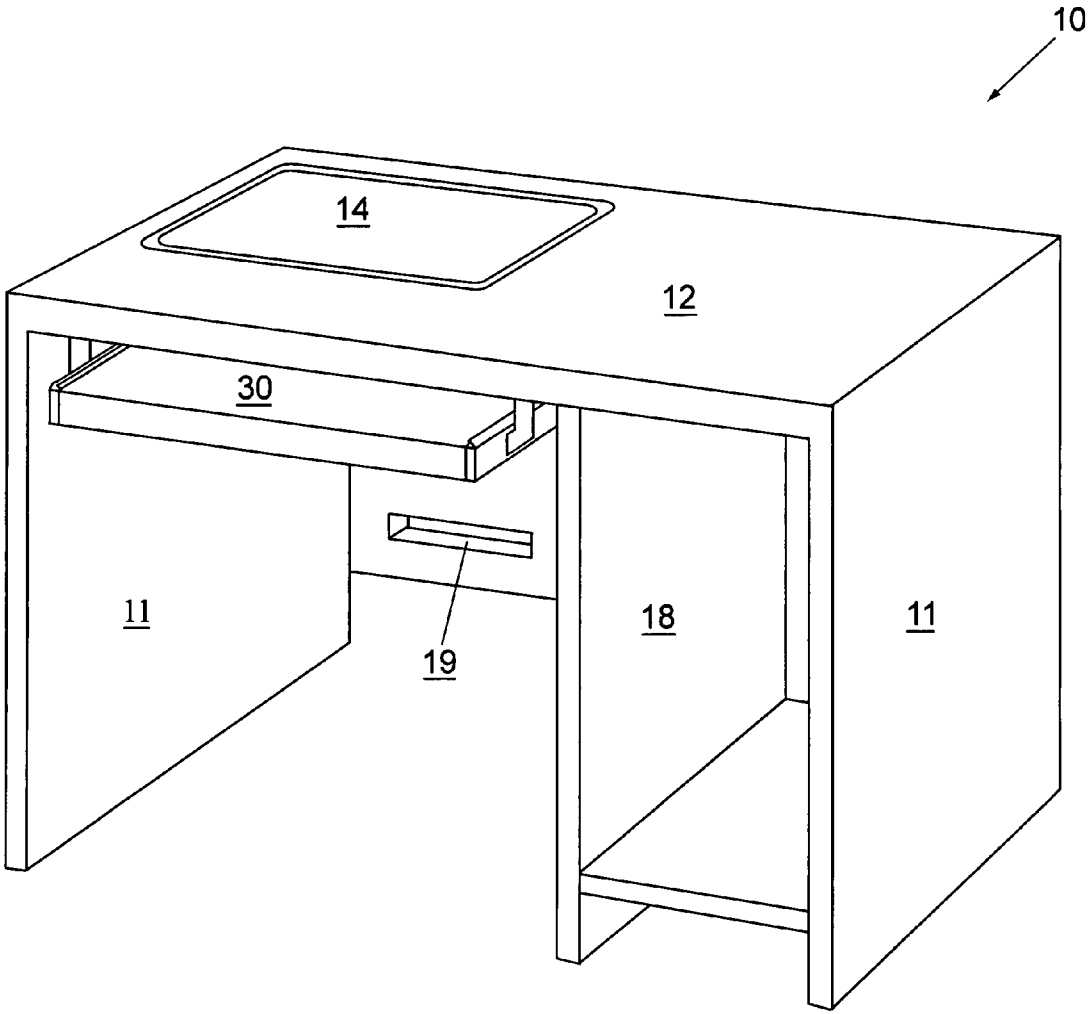
FIG. 1 is a front perspective view of a computer workstation 10, shown with a LCD support panel 14 in the closed position and a sliding input device platform 30 in a fully retracted position, according to a preferred embodiment of the present invention.

FIG. 1 is a front perspective view of a computer workstation 10 according to a preferred embodiment of the present invention. The computer workstation 10 generally includes a sliding input device platform 30 and a pivoting support panel 14 in a work surface 12, the support panel 14 being adapted to support an integrated flat panel LCD 60 (see FIG. 5) mounted thereon. In accordance with the present invention, a mechanism is provided (described below) by which extension of the input device platform 30 into a working position (see FIG. 5) automatically and gently rotates the flat panel LCD 60 to a viewable position in front of a user. Additionally, the rotation may automatically turn the LCD 60 on by means of a gravity switch.

Figure 2:
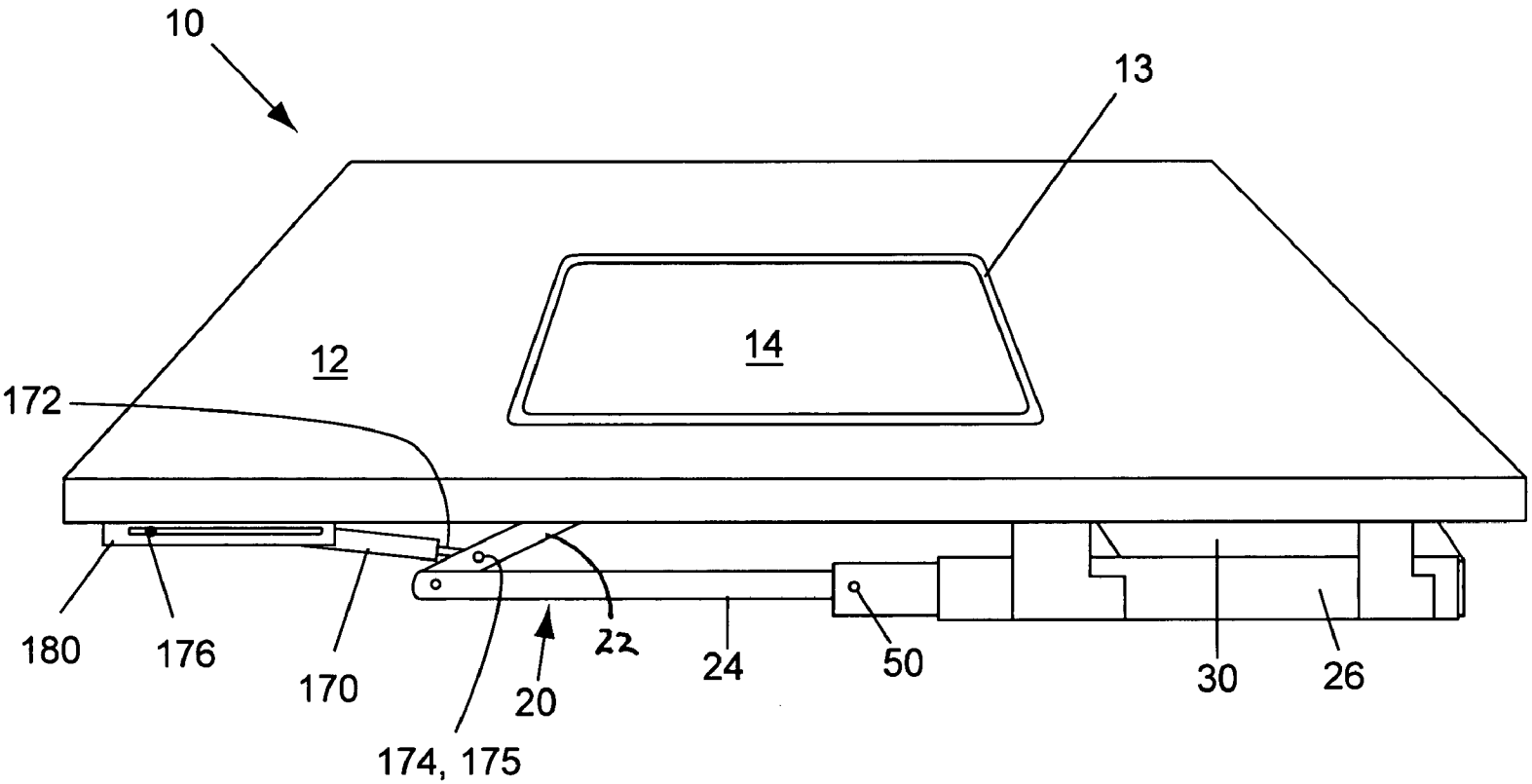
FIG. 2 is a side perspective view of the computer workstation 10 of FIG. 1, shown with the support panel 14 in a closed position.
Figure 3:
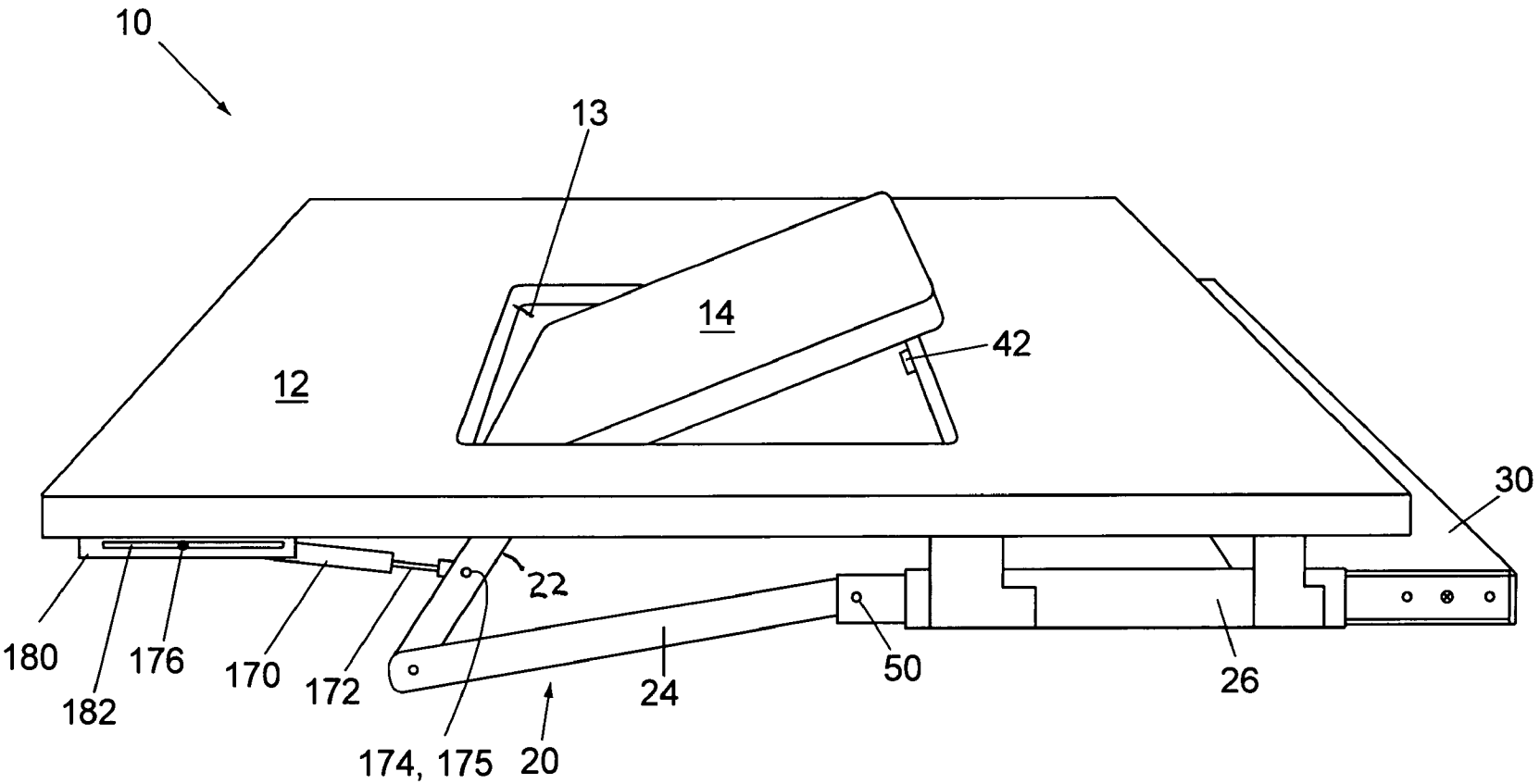
FIG. 3 is a side perspective view of the computer workstation 10 of FIGS. 1 and 2, shown with the support panel 14 in a partially open position.
Figure 4:
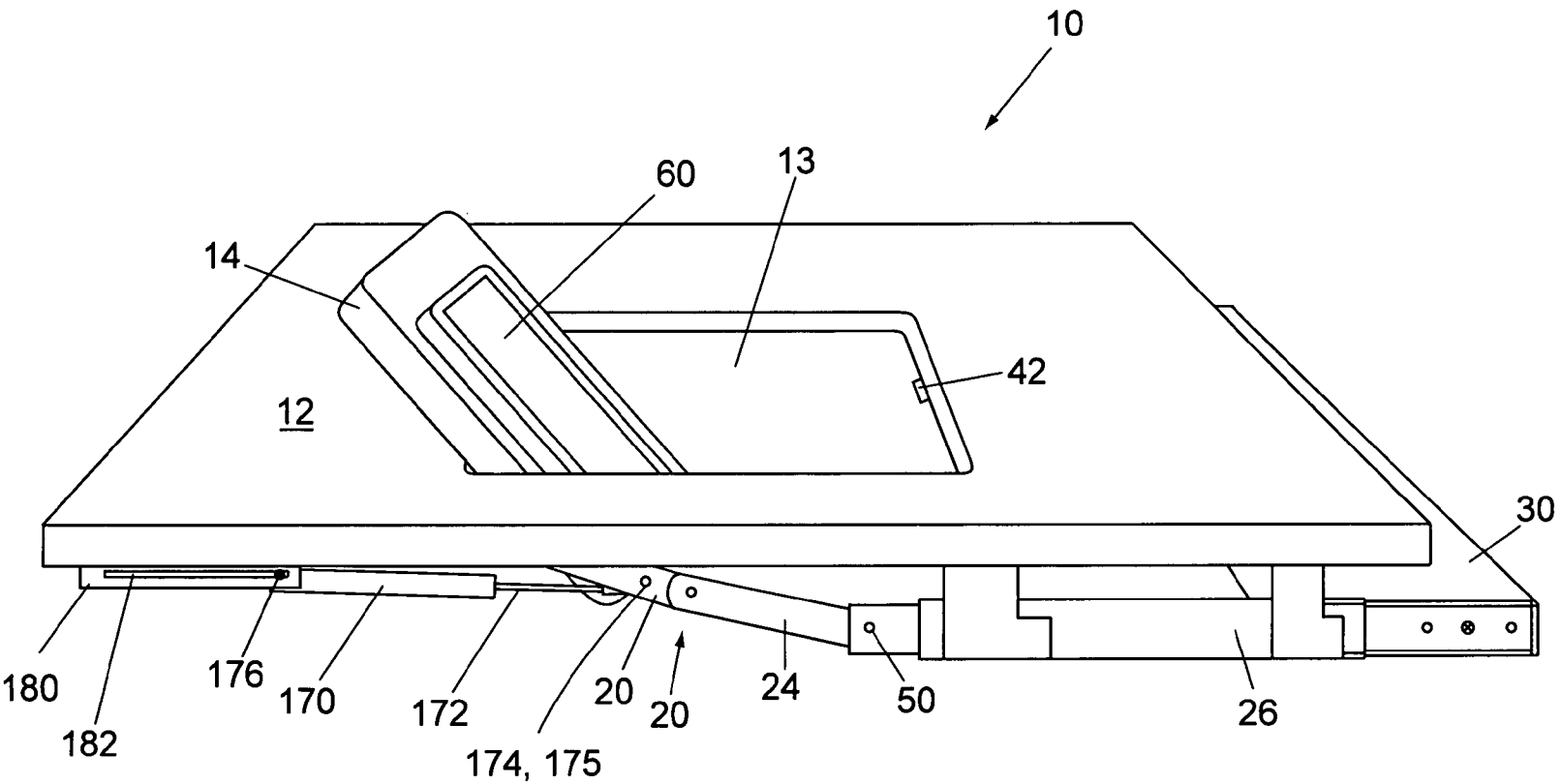
FIG. 4 is a side perspective view of the computer workstation 10 of FIGS. 1–3, shown with the support panel 14 and integrated flat panel LCD 60 in a fully open position.

FIGS. 2–4 are side perspective views of the computer workstation 10 with the support panel 14 and integrated flat panel LCD 60 shown, respectively, in closed, partially open, and fully open positions, according to a preferred embodiment of the present invention. The computer workstation 10 generally includes a desktop/work surface 12 defined by a central aperture 13 and a pivoting support panel 14 for supporting a flat panel LCD 60 positioned within the aperture 13. The support panel 14 sits flush within the aperture 13 of the work surface 12 when it is closed. The desktop/work surface 12 sits atop a foundation 11 (see FIG. 1) which is a conventional computer workstation frame bounded on three sides by side walls and having a built-in power strip 19 (see FIG. 1) for powering the computer and other auxiliary/peripheral equipment. The computer CPU (not shown in the Figures) may be a separate component from the flat panel LCD 60, in which case the CPU is stowed in a compartment 18 (see FIG. 1) inside the foundation 11. Alternatively, the CPU may be integrally built into the flat panel LCD 60.

The support panel 14 is side-mounted by two, collinear, pivot shafts 46 (see FIG. 6) which extend into bearing blocks 44 (see FIG. 6) mounted to the support panel 14. Lever assemblies 20, attached to the blocks 44 and thereby engaged with the support panel 14, rotate the panel 14 from a closed position to a fully open position. The lever assemblies 20 are manually-actuated by the input device platform 30 which is slidably suspended beneath the front edge of the work surface 12 (on roller brackets 26 which are affixed to the underside of the work surface 12 in a spaced relationship). Each lever assembly 20 further comprises a lever arm 22 and a link 24. Each link 24 is pivotally attached at one end to a roller bracket 26 via, for example, a shoulder bolt 50. A hydraulic, double-ended or uni-directional damper 170, commercially available from AVM, Inc. of Marion, S.C. (i.e. as part/model no. sd200acjps006), is pivotally attached via a block/pin assembly 174 and a spring 175 to one of the lever arms 22 and slidably attached via a second block/pin assembly 176 to a slotted bracket 180 affixed to the underside of the desktop/work surface 12. With the support panel 14 in the closed position of FIG. 2, the spring 175 is fully compressed and the damper's shaft 172 is fully retracted with the block/pin assembly 176 positioned at the back end of the slot 182 formed in the bracket 180.

The support panel 14 is pivoted to the partially open position of FIG. 3 by pulling the input device platform 30 out from under the front edge of the work surface 12. This action extends (i.e. telescopes outward) the two roller brackets 26 simultaneously. Movement of the roller brackets 26 then begins to draw the links 24 outward. The other ends of links 24 are pivotally attached to one end of the lever arms 22. Therefore, as links 24 move in response to the movement of the input device platform 30, lever arms 22 are pulled forward and slightly downward. Lever arms 22 in turn, via fixed attachments to bearing blocks 44 (see FIG. 6), rotate the support panel 14 from the closed position of FIG. 2 to the partially open position of FIG. 3. As the lever arms 22 respond to the extension of the input device platform 30, the spring 175 first begins to extend before eventually setting the damper 170 into motion. Movement of the damper 170 then causes the block/pin assembly 176 to traverse the slot 182 in the bracket 180.

FIG. 4 shows the computer workstation 10 with the support panel 14 in a fully open position due to the complete extension of the input device platform 30. The lever assemblies 20 are fully engaged with the support panel 14 to rotate it to an approximately 80 degree vertical upright position (the angular position is a matter of design choice). It can now be seen that a flat panel LCD 60 is fixedly mounted to the underside of support panel 14.

As the support panel 14 opens (i.e. rotates between the partially open position of FIG. 3 and the fully open position of FIG. 4), the block/pin assembly 176 traverses (left to right) the slot 182 in the bracket 180. However, the block/pin assembly 176 reaches the forward end of the slot 182 before the support panel 14 reaches its fully open position. When the motion of the block/pin assembly 176 is halted at the forward end of the slot 182, the shaft 172 of the damper 170 is freely extended as the support panel 14 opening process is completed. The extension of the shaft 172 in this manner readies the damper 170 for operation during the closing of the support panel 14. The damped movement of the support panel 14 during the closing process occurs in the following manner.

As the support panel 14 is returned to the closed position of FIG. 2, the block/pin assembly 176 traverses (right to left) the slot 182 in the bracket 180 and reaches the back end of the slot 182 before the panel 14 reaches the closed position. When the motion of the block/pin assembly 176 is halted at the back end of the slot 182, the shaft 172 of the damper 170 is pushed into the damper's body, thereby engaging the its internal, unidirectional motion damping system to bring the support panel 14 and attached LCD 60 to a safe and gentle stop in the closed position.

The spring 175 creates a minimal amount of shaft 172 extension just as the opening process commences (see FIG. 3). This minimal amount of shaft 172 extension, generating a small amount of motion damping capability in the damper 170, is a safety feature designed to prevent the support panel 14 from slamming shut should the opening process be accidentally aborted prior to completion (e.g. a user inadvertently letting go of the input device platform 30 when the support panel is in the position shown in FIG. 3, whereupon gravity would act to return the panel to the closed position of FIG. 2).

A stop bracket 42 is secured by, for example, a plurality of screws to the underside of the work surface 12 along the front edge of the aperture 13. The stop bracket 42 extends into the aperture 13 a short distance to limit the rotation of the support panel 14 and attached LCD 60, thereby ensuring that support panel 14 comes to rest flush with the work surface 12 when the desk 10 is closed (as in FIG. 2).

The LCD 60 is preferably a 15"–20" flat panel LCD with a power cord that plugs into the power strip resident in the computer workstation 10. The LCD 60 is conventional in most respects, but also includes an OEM-supplied and retrofitted mercury switch 62 (see FIG. 5) for selectively applying power to the unit dependant on its orientation. The mercury switch 62 is mounted such that power is supplied to the LCD 60 when it is positioned at approximately an 80 degree upright angular orientation.

Figure 5:
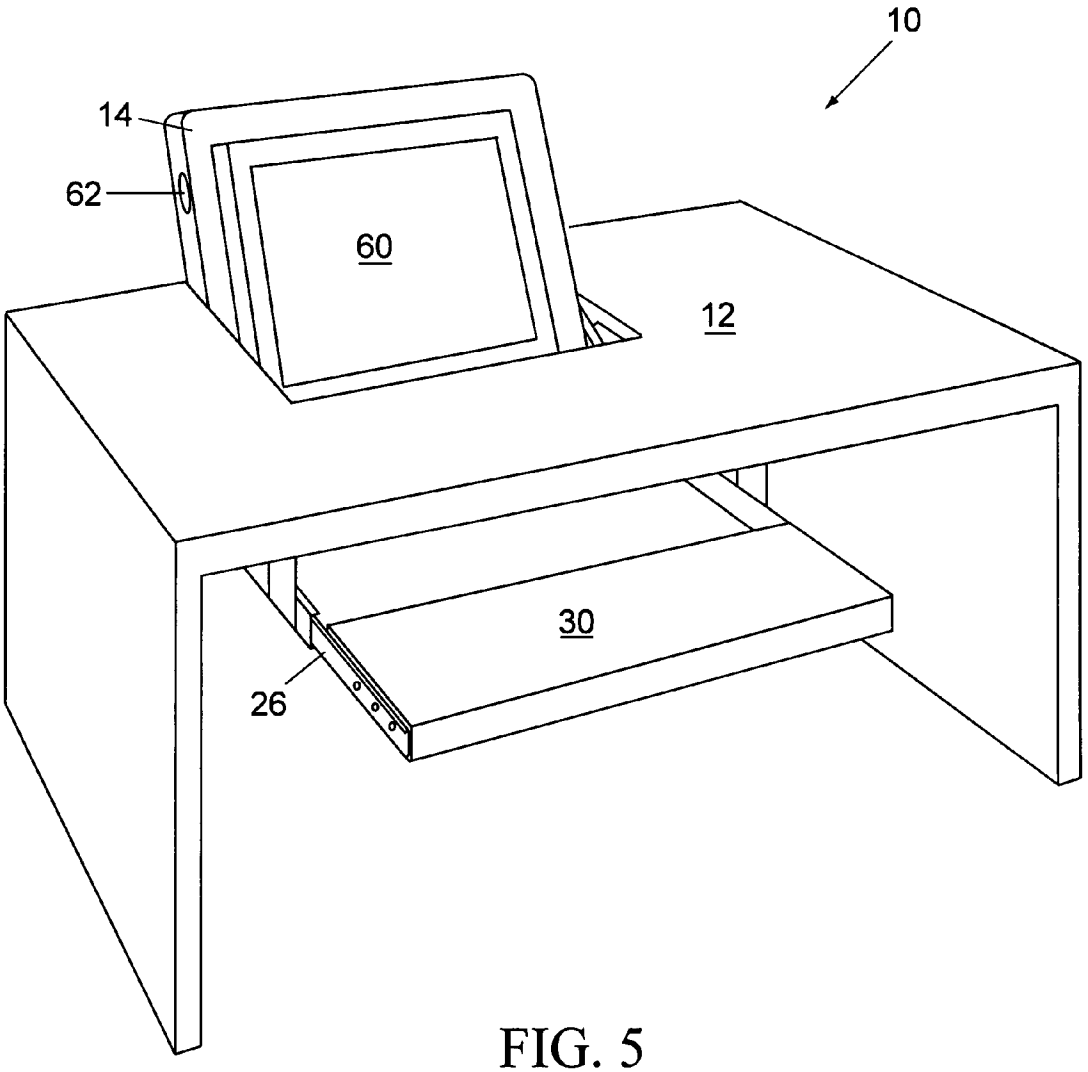
FIG. 5 is a front perspective view of the computer workstation 10 of FIGS. 1–4, shown with the support panel 14 and integrated flat panel LCD 60 in the fully open position, and the sliding input device platform 30 in a fully extended position.

FIGS. 1 and 5 are front perspective views of the computer workstation 10 shown with the support panel 14 in the closed and fully open positions, respectively, and the input device platform 30 in the fully retracted and extended positions, respectively.

Figure 6:
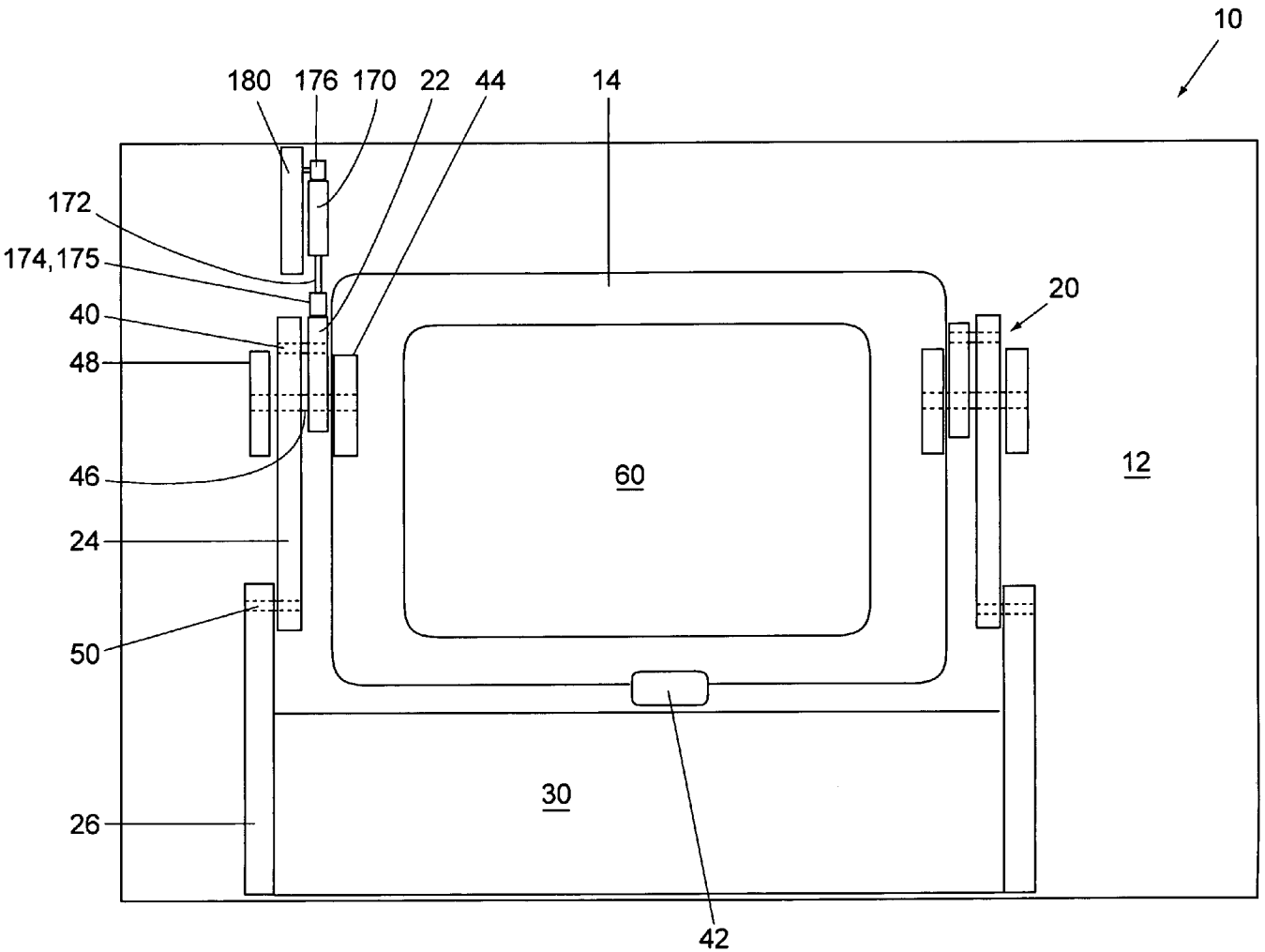
FIG. 6 is a bottom perspective view of the computer workstation 10 of FIGS. 1–5, shown with the support panel 14 and integrated flat panel LCD 60 in the closed position.

FIG. 6 is a bottom perspective view of the computer workstation 10, shown with the support panel 14 and integrated flat panel LCD 60 in the closed position, which further illustrates the lever assemblies 20. The lever assemblies 20 on either side are identical, and only one need be explained in detail. As explained previously, the support panel 14 is side-mounted by a shaft 46. Each shaft 46 extends into a bearing block 44 at one end and a mounting block 48 at the other end. The bearing block 44 is rotatably engaged with the shaft 46 and is anchored to the support panel 14 by, for example, a plurality of screws. The mounting block 48 is fixedly attached to the shaft 46 and is mounted to the underside of the work surface 12 by, for example, a plurality of screws. At a point between the two blocks 44, 48, one end of lever arm 22 is fixedly attached to the bearing block 44 and extends rearwardly and slightly downwardly therefrom. The other end of lever arm 22 is pivotally attached at hinge 40 to one end of link 24 as shown. The other end of link 24 is, in turn, pivotally attached to a roller bracket 26 via a hinge 50 (i.e. shoulder bolt) such that inward or outward movement of the input device platform 30 telescopes the roller bracket 26 and operates the lever arm 22 and link 24, thereby pivoting the support panel 14. The commercially-available hydraulic damper 170 is, via its shaft 172, pivotally attached by a block/pin assembly 174 and a spring 175 to one of the lever arms 22 and slidably attached via a second block/pin assembly 176 to a slotted bracket 180 affixed to the underside of the desktop/work surface 12.

The foregoing computer workstation 10 serves to automatically pivot the support panel 14, positioned in the work surface 12, and the attached flat panel LCD 60 into a vertical position in front of a user. The flat panel LCD 60 moves from a closed to an exposed position and is powered automatically when the user extends the sliding keyboard shelf 30. The mercury switch 62 in the LCD 60 closes upon attaining a substantially upright position, thereby ensuring that the LCD 60 is on only when desired.

Figure 7:
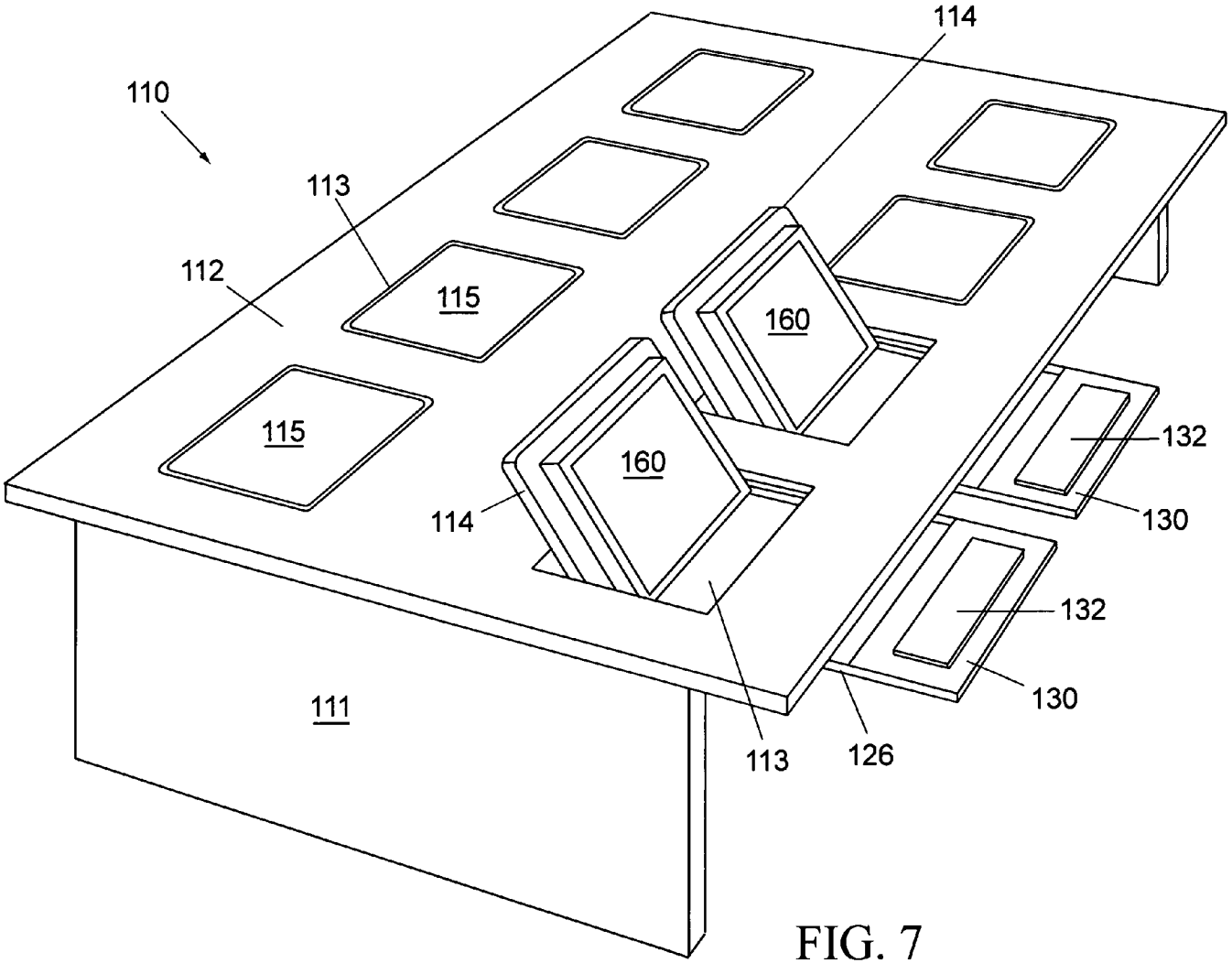
FIG. 7 is a top perspective view of a multi-station computer workstation/conference table 110 shown with two LCD support panels 114 in an open position, six support panels 115 in a closed position, and two sliding input device platforms 130 in a fully extended position, according to an alternative embodiment of the present invention.

FIG. 7 is a top perspective view of an alternative embodiment of the present invention. A multi-station computer workstation 110, or conference table, incorporates a tabletop/work surface 112 defined by two or more apertures 113, with a pivoting, integral LCD support panel 114, 115 positioned in each of the apertures 113. The eight-station embodiment of FIG. 7 shows two LCD support panels 114 in an open position and six support panels 115 in a closed position. Each support panel 115 sits flush within the aperture 113 of the work surface 112 when it is closed.

The work surface 112 sits atop a conventional conference table foundation 111. A plurality of built-in power strips (not shown in FIG. 7) for powering multiple computers and other auxiliary/peripheral equipment are affixed to the foundation 111. The computer CPUs (not shown in FIG. 7) may be separate components from the flat panel LCDs 160, in which case the CPUs are stowed in compartments (not shown in FIG. 7) inside the foundation 111. Alternatively, the CPU may be integrally built into the flat panel LCD 160.

Each of the support panels 114, 115 is mounted and cycled between its open and closed positions in the manner described above with respect to FIGS. 1–6 (i.e. utilizing the combination of two lever assemblies 20 and a hydraulic damper 170). Flat panel LCDs 160 are fixedly mounted to the underside of support panels 114, 115 and a sliding input device platform 130 is mounted on telescoping roller brackets 126 underneath the edge of the work surface 112 directly in front of each support panel 114, 115 and LCD 160. FIG. 7 shows the computer workstation 110 with the two support panels 114 in a fully open position (i.e. an 80 degree vertical upright position) due to the complete extension of the corresponding input device platforms 130 (supporting computer keyboards132). Stop brackets (not shown in FIG. 7) secured by, for example, a plurality of screws to the underside of the work surface 112 along the front edge of the aperture 113. Each stop bracket extends into the corresponding aperture 113 a short distance to limit the rotation of the support panel 114, 115 and attached LCD 160, thereby ensuring that support panel 114, 115 comes to rest flush with the work surface 112 when the desk 110 is closed (see specifically, support panels 115).

As above, each LCD 160 is preferably a 15"–20" flat panel LCD with a power cord that plugs into one of the power strips resident in the computer desk 110. The LCD 160 is conventional in most respects, but also includes an OEM-supplied, or retrofitted, mercury switch (not shown in FIG. 7) for selectively applying power to the unit dependant on its orientation. The mercury switch is mounted such that power is supplied to the LCD 160 when it is positioned at approximately an 80 degree upright angular orientation.

The foregoing alternative computer workstation/conference table 110 allows one or more users to automatically pivot a support panel 114, 115 and the attached flat panel LCD 160 into a vertical, viewable position. Each LCD 160 may be pivoted from a closed to an exposed position and be powered automatically, independently of the others, by extending the corresponding input device platform 130. The mercury switch in each LCD 160 closes upon attaining a substantially upright position, thereby ensuring that an LCD 160 is on only when desired.

As a preferred option, the sliding input device platforms 30, 130, in the embodiments described above with respect to FIGS. 1–7, are each equipped with a locking device, which prevents unauthorized access to the keyboard and the LCD 60, 160, when protection of either the hardware and/or data is desired (as set forth previously, it is contemplated that the computer CPU may be integral to the display 60, 160, in which case the locking device prevents unauthorized data access as well). While the locking device may be a simple keylock, the presently preferred embodiment includes a Dialock® system by which multiple computer workstations 10 all with pivoting LCD support panels 14 may be centrally unlocked using a single transponder stick inserted in a wall receptacle. This particular intelligent key system is commercially-available and completely tamper-proof. The Dialock® system is incorporated as follows.

Figure 8:
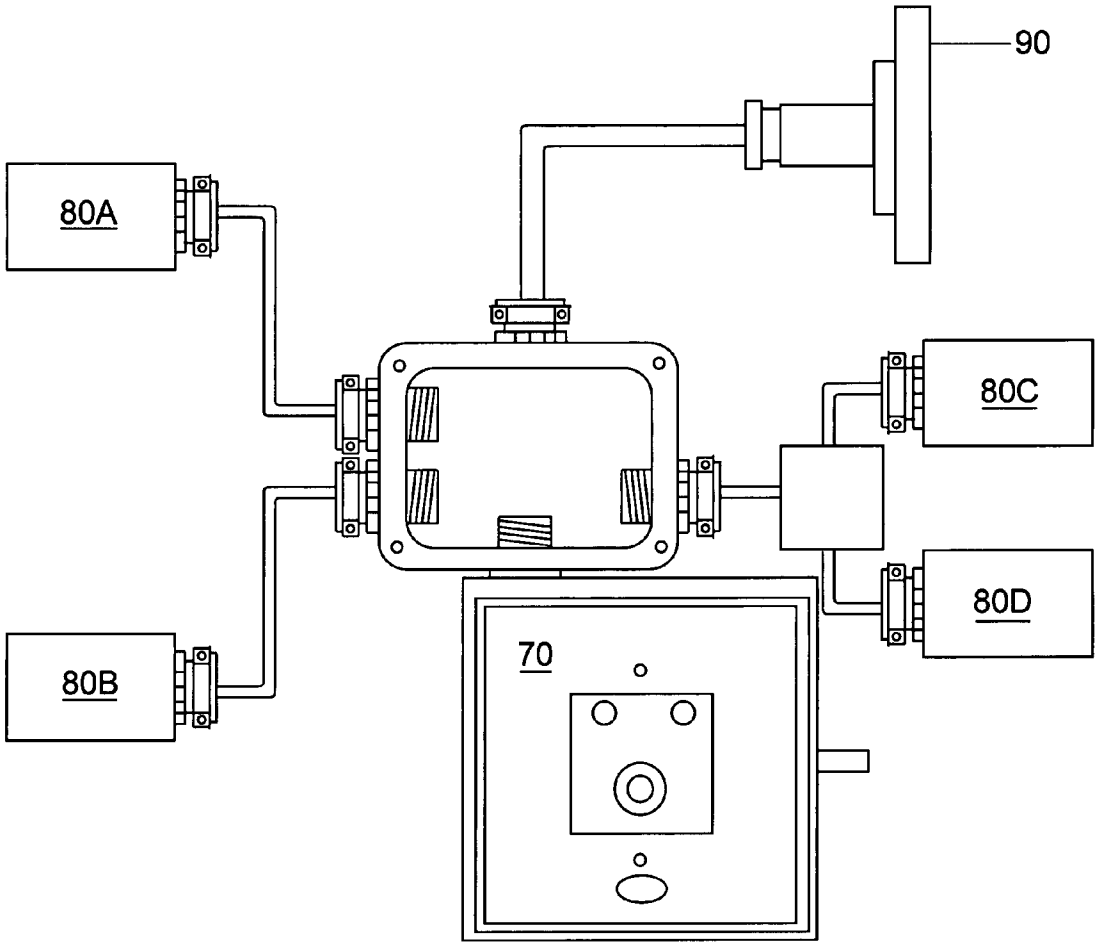
FIG. 8 is a system diagram of a Dialock® system by which all of the pivoting LCD support panels 14, 114 in multiple computer workstation 10 or in multi-station computer workstations/conference tables 110, as described above, may be centrally locked and/or unlocked using a single transponder stick inserted in a wall receptacle 90.

FIG. 8 is a system diagram of a Dialock® system by which all of the pivoting LCD support panels 14, 114 in multiple computer workstations 10 or in multi-station computer workstations/conference tables 110, as described above, may be centrally locked and/or unlocked using a single transponder stick inserted in a wall receptacle 90. The system generally includes a programmable central controller 70, a wall-mount receptacle 90 connected to the central controller 70 for insertion of a key-transponder, and multiple remote lock assemblies 80*a*–*d* connected to the central controller 70. The lock assemblies 80*a*–*d* are installed proximate each of the sliding input device platforms 30, 130 to lock them and the corresponding LCDs 60, 160 in the closed position, subject to authorized key access via receptacle 90. All of the foregoing components are commercially available from The Häfele Group.

Figure 9:
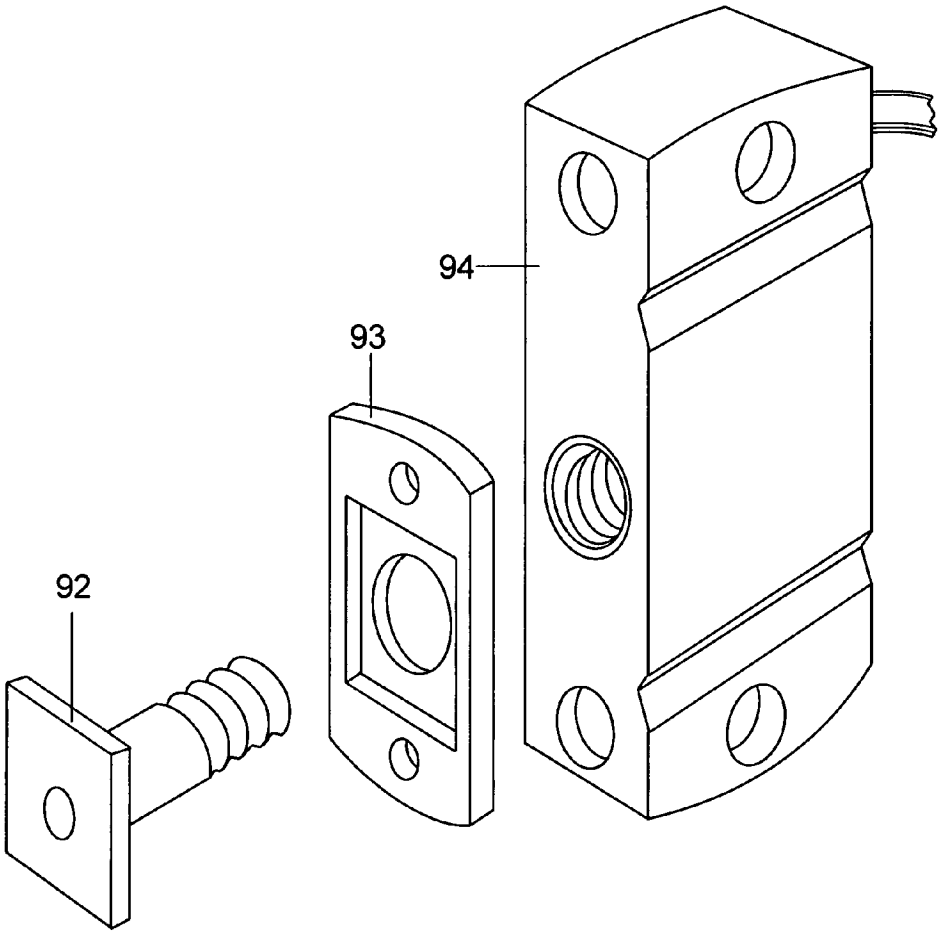
FIG. 9 is an exploded diagram of the Dialock® locking device which is installed at each of the sliding input device platforms 30, 130 to lock/unlock them.

FIG. 9 is an exploded diagram of one of the Dialock® remote lock assemblies 80*a*–*d* (see FIG. 8) installed at each of the sliding input device platforms 30, 130 to lock/unlock them. Each remote lock assembly 80*a*–*d* further comprises a locking shaft 92 which is secured to the inside edge of the sliding input device platform 30, 130 (by screws), a reinforcing receptacle plate 93 which is secured inside a computer workstation 10, or a multi-station computer workstation/conference table 110, in a position corresponding to the closed position of the sliding input device platforms 30, 130 and an electronic lock 94 which is secured to and behind receptacle plate 93. When the locking shaft 92 is inserted into the electronic lock 94 by closure of the sliding input device platforms 30, 130 (and commensurate closure of the corresponding LCDs 60, 160), the electronic lock 94 locks it in the closed position subject to keyed access at receptacle 90 (see FIG. 8). This option allows multiple computer workstations 10 all with pivoting LCD support panels 14 to be centrally unlocked using a single transponder stick inserted in wall receptacle 90, and renders the enclosed keyboard and LCD completely tamper-proof.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

We claim:

1. A workstation adapted to support a flat panel LCD display, comprising:

a foundation;

a work surface fixedly attached to said foundation and defined by an aperture;

a flat panel LCD display support panel pivotally mounted in said aperture for pivoting between an open angled-position and a closed position seated flush with said work surface within said aperture, said flat panel LCD display support panel being adapted for mounting and supporting a flat panel LCD directly thereon;

an input device platform slidably attached to an underside of said work surface for sliding there beneath between a fully concealed closed position and a substantially exposed extended position;

a pair of extensible roller guide brackets on each side of said input device platform for slidable mounting under said work surface;

a lever mechanism including at least one arm operatively coupled at one end to a side of said flat panel LCD support panel and protruding outward there from, and at least one link coupled between another end of said arm and said extensible roller guide brackets for automatically pivoting said flat panel LCD display support panel to said open angled position upon extension of said input device platform, and for automatically moving said flat panel LCD display support panel to said closed flush position upon closure of said input device platform; and a damping mechanism for damping movement of said flat panel LCD display support panel.

2. The workstation according to claim 1, wherein said damping mechanism further comprises a motion damping cylinder pivotally attached between said lever assembly and an underside of said work surface for bringing said flat panel LCD display support panel to a gentle stop at said closed flush position.

3. The workstation according to claim 1, further comprising a stop bracket fixedly mounted in said aperture for limiting movement of said flat panel LCD display support panel.

4. The workstation according to claim 1, further comprising a flat panel LCD fixedly attached to said flat panel LCD support panel.

5. The workstation according to claim 4, wherein said LCD further comprises a mercury switch for automatically applying power to said LCD upon said flat panel LCD display support panel attaining said open, angled position.

6. The workstation according to claim 1, wherein said flat panel LCD display support panel is mounted in said aperture on opposing pivot shafts.

7. The workstation according to claim 6, wherein said pivot shafts rotatably engages two respective bearing blocks fixedly attached to an underside of said work surface.

8. The workstation according to claim 6, wherein said pivoted flat panel LCD support panel mounted in said aperture on opposing pivot shafts is urged by said lever mechanism toward said closed flush position and gravity on said flat panel LCD support panel and affixed LCD return the panel to said closed position subject to said damping mechanism.

9. The workstation according to claim 1, wherein said pair of opposing roller guide brackets further comprise two telescoping roller guide brackets.

10. The workstation according to claim 1, further comprising a lock for locking said keyboard shelf in a closed position.

11. The workstation according to claim 10, wherein said lock is an electronic lock.

12. A workstation/conference table adapted for supporting one or more integrated LCD flat panel displays, comprising:

a foundation;

a work surface fixedly attached to said foundation and defined by a plurality of apertures;

a plurality of flat panel LCD display support panels, each of said flat panel LCD display support panels being mounted in a corresponding one of said apertures for pivoting between an open angled-position and a closed position seated flush with said work surface within said corresponding aperture, said flat panel LCD display support panels each being adapted for mounting and supporting a flat panel LCD directly thereon;

a plurality of input device platforms each being movably mounted on roller guide brackets to a side of said work surface and in front of said apertures for sliding beneath said work surface between a fully concealed closed position and a substantially exposed extended position;

a plurality of lever assemblies each coupled between an input device platform and a flat panel LCD display support panel for selectively and automatically pivoting said flat panel LCD display support panel open upon extension of the corresponding input device platform, and closed upon closure of the corresponding input device platform.

13. The workstation/conference table according to claim 12, further comprising a plurality of motion damping cylinders each pivotally attached between a corresponding lever assembly and the underside of said work surface for bringing a display support panel to a gentle stop at closure thereof.

14. The workstation/conference table according to claim 12, wherein said input device platforms are each slidably mounted to an underside of said work surface by a pair of extensible roller guide brackets.

15. The workstation/conference table according to claim 14, wherein each of said pairs of extensible roller guide brackets further comprise two telescoping, roller guide brackets.

16. The workstation/conference table according to claim 12, further comprising a lock for locking said input device platform in a closed position.

17. The workstation/conference table according to claim 16, wherein said lock is an electronic lock.

* * * * *